US011335230B2

(12) United States Patent
Wang et al.

(10) Patent No.: US 11,335,230 B2
(45) Date of Patent: May 17, 2022

(54) DISPLAY PANEL

(71) Applicant: TCL CHINA STAR OPTOELECTRONICS TECHNOLOGY CO., LTD., Shenzhen (CN)

(72) Inventors: Tianhong Wang, Shenzhen (CN); Yunxiao Zhong, Shenzhen (CN); Ilgon Kim, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 34 days.

(21) Appl. No.: 17/053,352

(22) PCT Filed: Aug. 4, 2020

(86) PCT No.: PCT/CN2020/106729

§ 371 (c)(1),
(2) Date: Nov. 5, 2020

(87) PCT Pub. No.: WO2022/007071

PCT Pub. Date: Jan. 13, 2022

(65) Prior Publication Data

US 2022/0013056 A1 Jan. 13, 2022

(30) Foreign Application Priority Data

Jul. 7, 2020 (CN) ..... 202010648369.9

(51) Int. Cl.
*G09G 3/20* (2006.01)

(52) U.S. Cl.
CPC ... *G09G 3/2003* (2013.01); *G09G 2300/0452* (2013.01); *G09G 2310/0278* (2013.01)

(58) Field of Classification Search
CPC ..... G09G 3/2003; G09G 2300/0452; G09G 2310/0278
See application file for complete search history.

(56) References Cited

U.S. PATENT DOCUMENTS

| | | | | |
|---|---|---|---|---|
| 10,546,550 | B2 * | 1/2020 | Sun | G09G 3/3688 |
| 2003/0035081 | A1 | 2/2003 | Jung et al. | |
| 2016/0246144 | A1 | 8/2016 | Liao et al. | |
| 2016/0335982 | A1 | 11/2016 | Park et al. | |
| 2017/0330515 | A1 * | 11/2017 | Jeong | G09G 3/3266 |

(Continued)

FOREIGN PATENT DOCUMENTS

| | | | |
|---|---|---|---|
| CN | 102385200 | A | 3/2012 |
| CN | 104575349 | A | 4/2015 |

(Continued)

*Primary Examiner* — Sejoon Ahn
(74) *Attorney, Agent, or Firm* — PV IP PC; Wei Te Chung; Ude Lu

(57) ABSTRACT

The present application provides a display panel. The display panel includes multiple sub-pixels, multiple data lines, multiple scan lines, and multiple gate fan-out lines. Each two columns of the sub-pixels constitute a sub-pixel group, two data lines are arranged between the two columns of the sub-pixels in the sub-pixel group, and any two adjacent gate fan-out lines are spaced by at least one sub-pixel group. A width of the gate fan-out line is not less than a sum of widths of the two data lines in the sub-pixel group.

18 Claims, 2 Drawing Sheets

(56) References Cited

U.S. PATENT DOCUMENTS

2017/0330517 A1* 11/2017 Gu ..... H01L 51/5206
2017/0330518 A1* 11/2017 Lee ..... G09G 3/2003

FOREIGN PATENT DOCUMENTS

| | | | |
|---|---|---|---|
| CN | 105372891 | A | 3/2016 |
| CN | 107561799 | A | 1/2018 |
| CN | 109616481 | A | 4/2019 |
| CN | 110085125 | A | 8/2019 |
| CN | 110265408 | A | 9/2019 |
| CN | 111243486 | A | 6/2020 |

* cited by examiner

DISPLAY PANEL

This application is a Notional Phase of PCT Patent Application No. PCT/CN2020/106729 having international filing date of Aug. 4, 2020, which claims priority to Chinese Patent Application No. 202010648369.9, entitled "Display Panel", filed on Jul. 7, 2020, the entire contents of which are incorporated by reference in this application.

FIELD OF DISCLOSURE

The present application relates to a field of display panel technology and in particular, to a display panel.

DESCRIPTION OF RELATED ART

In recent years, large-sized, high-resolution, ultra-narrow border (UNB) display screens have become a market trend, and splicing screens which get the market's great attention require that the display screens have extremely narrow borders. At present, a gate driver on array (GOA) circuit is set on the same side border as a source driver circuit (GOA in source border), and the GOA in source border is a popular technology to realize a splicing display screen having extremely narrow borders on its three sides.

In order to arrange the GOA circuit and the source driver circuit on the same side, a gate fan-out line is designed, so that the GOA circuit is electrically connected to a scan line through the gate fan-out line. However, a line width of the gate fan-out line is very small, which results in a large load and low capacitance, thus causing a long signal delay in the gate fan-out line and reducing charging efficiency of sub-pixels.

The present application provides a display panel to solve a problem of long signal delay in a gate fan-out line in conventional techniques.

SUMMARY

The present application provides a display panel. The display panel comprises a display region and a non-display region arranged at one side of the display region, wherein the display region comprises:

a plurality of sub-pixels arranged in rows and columns;

a plurality of data lines arranged in a one-to-one correspondence with the columns of the sub-pixels;

a plurality of scan lines arranged in a one-to-one correspondence with the rows of the sub-pixels; and a plurality of gate fan-out lines connected to the scan lines in a one-to-one correspondence;

wherein the data lines and the gate fan-out lines extend in a column direction to the non-display region, each two columns of the sub-pixels constitute a sub-pixel group, two data lines are arranged between the two columns of the sub-pixels in the sub-pixel group, and any two adjacent gate fan-out lines are spaced by at least one sub-pixel group; and wherein a gap is defined between the two data lines in the sub-pixel group, and a width of the gate fan-out line is equal to a sum of widths of the two data lines in the sub-pixel group and a width of the gap.

The gate fan-out lines and the data lines are arranged in a same layer, and the gate fan-out lines are arranged in a different layer from the scan lines.

A gate insulating layer is arranged between the gate fan-out lines and the scan lines, via holes are defined in the gate insulating layer, and the gate fan-out lines are electrically connected to the corresponding scan lines through the via holes.

The display panel further comprises a light shielding layer; and the light shielding layer is arranged corresponding to the data lines, the scan lines, and the gate fan-out lines.

The light shielding layer comprises a plurality of first light shielding patterns and a plurality of second light shielding patterns; and orthographic projections of the first light shielding patterns projected on a layer where the gate fan-out lines are located completely cover the gate fan-out lines, and orthographic projections of the second light-shielding patterns projected on a layer where the data lines are located completely cover the two data lines in the sub-pixel group.

A length of the first light shielding pattern in a row direction is equal to a length of the second light shielding pattern in the row direction.

The non-display region comprises a gate driving circuit and a source driving circuit; and the gate driving circuit is electrically connected to the gate fan-out lines, and the source driving circuit is electrically connected to the data lines.

The gate driving circuit comprises multi-stage gate driving units; and the multi-stage gate driving units are electrically connected to the gate fan-out lines in a one-to-one correspondence.

The source driving circuit is arranged at one side of the gate driving circuit away from the display region, and the multi-stage gate driving units are arranged in parallel and spaced apart from each other; and the data lines extend to the source driving circuit through gaps between the multi-stage gate driving units, and are electrically connected to the source driving circuit.

The present application further provides a display panel which comprises a display region and a non-display region arranged at one side of the display region, wherein the display region comprises:

a plurality of sub-pixels arranged in rows and columns;

a plurality of data lines arranged in a one-to-one correspondence with the columns of the sub-pixels;

a plurality of scan lines arranged in a one-to-one correspondence with the rows of the sub-pixels; and a plurality of gate fan-out lines connected to the scan lines in a one-to-one correspondence;

wherein the data lines and the gate fan-out lines extend in a column direction to the non-display region, each two columns of the sub-pixels constitute a sub-pixel group, two data lines are arranged between the two columns of the sub-pixels in the sub-pixel group, and any two adjacent gate fan-out lines are spaced by at least one sub-pixel group;

wherein a width of the gate fan-out line is greater than or equal to a sum of widths of the two data lines in the sub-pixel group.

The gate fan-out lines and the data lines are arranged in a same layer, and the gate fan-out lines and the scan lines are arranged in different layers.

A gate insulating layer is arranged between the gate fan-out lines and the scan lines, via holes are defined in the gate insulating layer, and the gate fan-out lines are electrically connected to the corresponding scan lines through the via holes.

The display panel further comprises a light shielding layer; and the light shielding layer is arranged corresponding to the data lines, the scan lines, and the gate fan-out lines.

The light shielding layer comprises a plurality of first light shielding patterns and a plurality of second light shielding patterns; and orthographic projections of the first light shielding patterns projected on a layer where the gate fan-out lines are located completely cover the gate fan-out lines, and orthographic projections of the second light shielding patterns projected on a layer where the data lines are located completely cover the two data lines in the sub-pixel group.

A length of the first light shielding pattern in a row direction is the same as a length of the second light shielding pattern in the row direction.

The non-display region comprises a gate driving circuit and a source driving circuit; and the gate driving circuit is electrically connected to the gate fan-out lines, and the source driving circuit is electrically connected to the data lines.

The gate driving circuit comprises multi-stage gate driving units; and the multi-stage gate driving units are electrically connected to the gate fan-out lines in a one-to-one correspondence.

The source driving circuit is arranged at one side of the gate driving circuit away from the display region, and the multi-stage gate driving units are arranged in parallel and spaced apart from each other; and the data lines extend to the source driving circuit through gaps between the multi-stage gate driving units, and are electrically connected to the source driving circuit.

The data lines and the gate fan-out lines are arranged extending along the column direction to the non-display region, every two columns of the sub-pixels constitute a group of the sub-pixels, two data lines are arranged between two columns of the sub-pixels in each group of the sub-pixels, any two adjacent gate fan-out lines are spaced by at least one group of the sub-pixels, and the width of the gate fan-out line is not less than a sum of the widths of the two data lines in one group of the sub-pixels. Accordingly, the present application realizes a narrow-frame display panel, and at the same time, shortens signal delays in the gate fan-out lines, improves a sub-pixel charging rate, and prevents wrong charging.

BRIEF DESCRIPTION OF DRAWINGS

A detailed description is provided below to describe the present application with reference to specific embodiments and in conjunction with the accompanying drawings to make the technical solutions and other beneficial effects of the present application obvious.

DETAILED DESCRIPTION OF EMBODIMENTS

Figure 1:
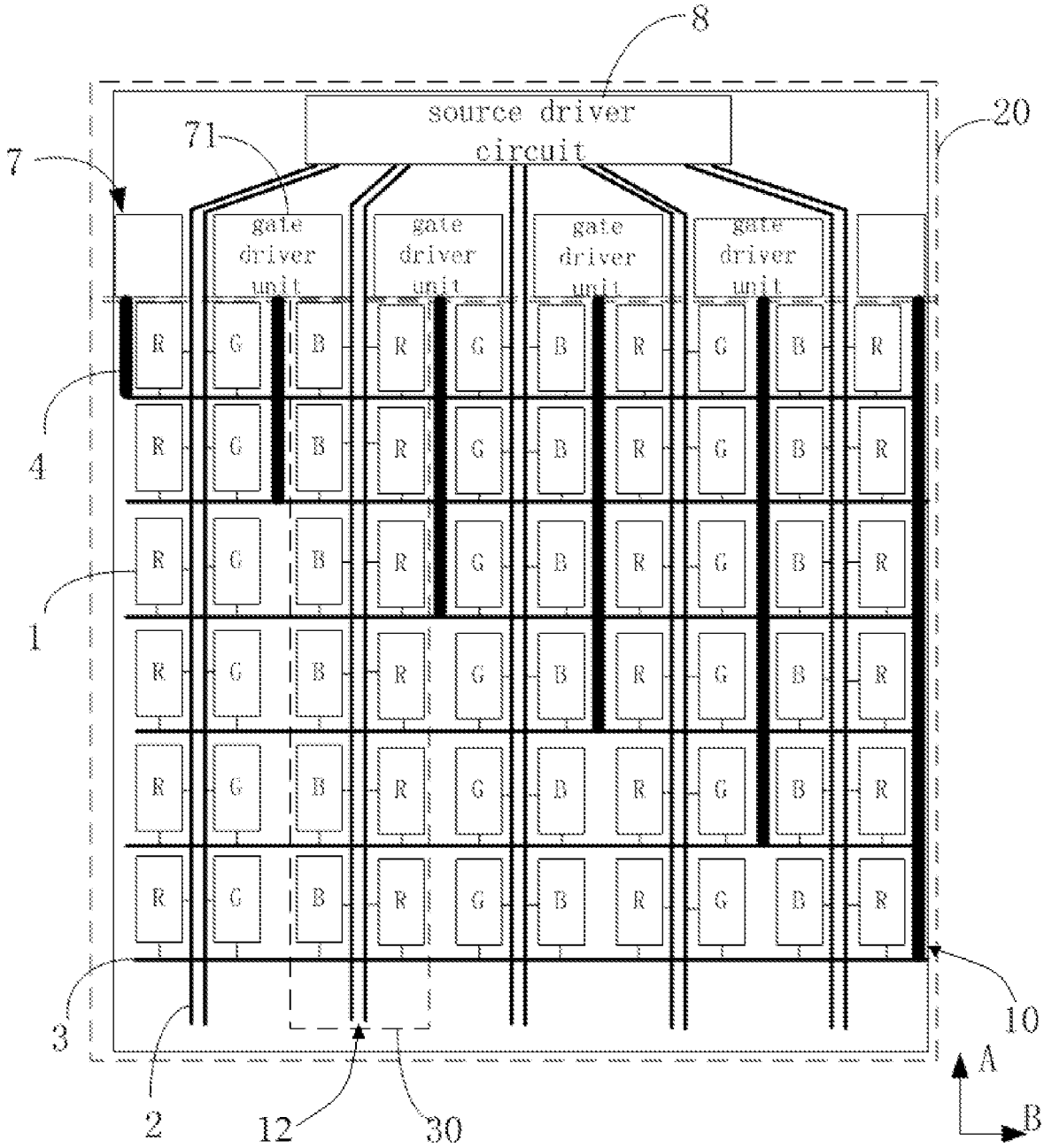
FIG. 1 is a schematic structural view illustrating a display panel according to one embodiment of the present application.

The structure and functional details disclosed herein are only representative, and are used for the purpose of describing example embodiments of the present application. However, the present application can be embodied in many alternative forms, and should not be interpreted as being limited to the embodiments set forth herein.

In the description of the present application, it should be understood that directional terms such as "center", "lateral", "upper", "lower", "left", "right", "vertical", "horizontal", "top", "bottom", "inner", and "outer" are used for illustrative purposes based on the orientation or positional relationship shown in the drawings. The directional terms do not indicate or imply that a device or an element must have a specific orientation, or must be constructed and operated in a specific orientation. Therefore, the directional terms cannot be understood as a limitation of the present application. In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features. In the description of the present application, "multiple" means two or more, unless otherwise specified. In addition, the term "comprising" and any variations thereof are intended to cover non-exclusive inclusion.

In the description of this application, it should be noted that the terms "installation", "coupled to", and "connected to" should be understood in a broad sense unless otherwise clearly specified and defined. For example, elements can be fixedly, detachably, or integrally connected to each other. Elements can be physically connected or electrically connected to each other; elements can be directly connected or indirectly connected through an intermediate medium; and interior spaces of two elements can communicate with each other. For those of ordinary skill in the art, the specific meaning of the above-mentioned terms in the present application can be determined on a case by case basis.

The terms used herein are only for describing specific embodiments and are not intended to limit the example embodiments. Unless otherwise specifically defined, the singular forms "a" and "one" used herein are also intended to include the plural forms. It should be noted that the terms "including" and/or "comprising" used herein mean containing the stated features, the numbers, steps, operations, units and/or components, but do not exclude addition of one or more of other features, numbers, steps, operations, units, components, and/or combinations thereof.

The present application is described below in conjunction with the accompanying drawings and specific embodiments.

Referring to FIG. 1, a display panel is provided according to one embodiment of the present application. The display panel includes a display region 10 and a non-display region 20. The non-display region 20 is arranged at one side of the display region 10 to ensure that three sides of the display panel having an extremely-narrow bezel design or a bezelless design.

The display region 10 comprises:

a plurality of sub-pixels 1 arranged in rows and columns;

a plurality of data lines 2 arranged in a one-to-one correspondence with the columns of the sub-pixels 1;

a plurality of scan lines 3 arranged in a one-to-one correspondence with the rows of the sub-pixels 1; and a plurality of gate fan-out lines 4 connected to the scan lines 3 in a one-to-one correspondence;

wherein the data lines 2 and the gate fan-out lines 4 extend in a column direction A to the non-display region, that is, the display region 10 and the non-display region 20 are arranged along the column direction A. The scan lines 3 extend along a row direction B, and the data lines 2 and the scan lines 3 are arranged in different layers, so that the data lines 2 and the scan lines 3 are insulated from each other and intersect to define the sub-pixels 1.

Scan lines 3 are arranged in one-to-one correspondence with the rows of the sub-pixels 1, that is, the number of the scan lines 3 is the same as the number of the rows of the sub-pixels 1, so that when each row of the sub-pixels 1 is scanned, scan signals are fed to the sub-pixels 1 of each row through the scan line corresponding to each row of the sub-pixels 1. The data lines 2 are arranged in one-to-one correspondence with the columns of the sub-pixels 1, that is, the number of the data lines 2 is the same as the number of the columns of the sub-pixels 1. Accordingly, during a period of feeding the scan signals to each row of the sub-pixels 1, the data lines 2 sequentially input data signals to the sub-pixels of respective columns in each row of the sub-pixels 1 to sequentially charge the sub-pixels 1 in each row.

The gate fan-out lines 4 extend along the column direction A to the non-display region 20, that is, the gate fan-out lines 4 and the data lines 2 are arranged parallel to each other in the same layer. The number of the gate fan-out lines 4 is the same as the number of the scan lines 3, and the gate fan-out lines 4 are electrically connected to the scan lines 3 in a one-to-one correspondence. When each row of the sub-pixels 1 is scanned, the scan signal is transmitted to the corresponding scan line 3 through the corresponding gate fan-out line 4, and then transmitted to the corresponding row of the sub-pixels 1.

As shown in FIG. 1, among the sub-pixels 1, there is a gap between any two adjacent columns of the sub-pixels 1, and every two columns of the sub-pixels 1 constitute a group of the sub-pixels 1, that is, a sub-pixel group 30. In each group of the sub-pixels 1, i.e., in each sub-pixel group 30, two data lines 2 are arranged in the gap between two columns of the sub-pixels 1, and the two columns of the sub-pixels 1 are arranged corresponding to the two data lines 2, respectively. In other words, the two data lines 2 respectively input data signals to the corresponding two columns of the sub-pixels 1.

Any two adjacent gate fan-out lines 4 are spaced by at least one group of the sub-pixels 1, i.e., spaced by at least one sub-pixel group 30. As shown in FIG. 1, there is one sub-pixel group 30 between any two adjacent gate fan-out lines 4, that is, the gate fan-out line 4 is located in a gap between two adjacent sub-pixel groups 30, and the data line 2 is located in the gap between two columns of the sub-pixels 1 in each sub-pixel group 30, so that the gate fan-out line 4 and the data line 2 are located in different gaps. In detail, the gate fan-out line 4 and the data line 2 is spaced by at least one column of the sub-pixels 2, so as to prevent the gate fan-out line 4 and the data line 2 from being too close to be coupled with each other to cause uneven display effects (i.e., mura).

A width of the gate fan-out line 4 is not less than a sum of widths of the two data lines 2 in one group of the sub-pixels 1, and the width of the gate fan-out line 4 is less than a width of the gap between two adjacent columns of the sub-pixels 1, i.e., less than a distance between two adjacent columns of the sub-pixels. The width of the gate fan-out line 4 refers to a length of the gate fan-out line 4 in the row direction B, and the sum of the widths of the two data lines 2 refers to a sum of lengths of the two data lines 2 in the row direction B. In the present embodiment, by increasing the width of the gate fan-out line 4 to be at least twice the width of the data line 2, a load is effectively reduced, and a capacitance is increased, thereby shortening a delay of the scan signal in the gate fan-out line 4. Accordingly, when each row of the sub-pixel 1 is scanned, a rising time that it takes for the scan signal to rise from a low level to a high level and a falling time that it takes for the scan signal to fall from a high level to a low level are reduced to thereby ensure a charging time of each sub-pixel in the sub-pixel 1, improve a charging rate of the sub-pixels 1, and prevent wrong charging.

In one embodiment, there is a gap between the two data lines 2 in one group of the sub-pixels 1 (i.e., one sub-pixel group 30), and the width of the gate fan-out line 4 is equal to the sum of the widths of the two data lines 2 in the group of the sub-pixels 1 and a width of the gap between the two data lines 2. In practice, a delay time in the gate fan-out line 4 is reduced from 1.01 us (a delay time in conventional techniques) to 0.87 us, so the delay time of the scan signal is effectively reduced.

Figure 2:
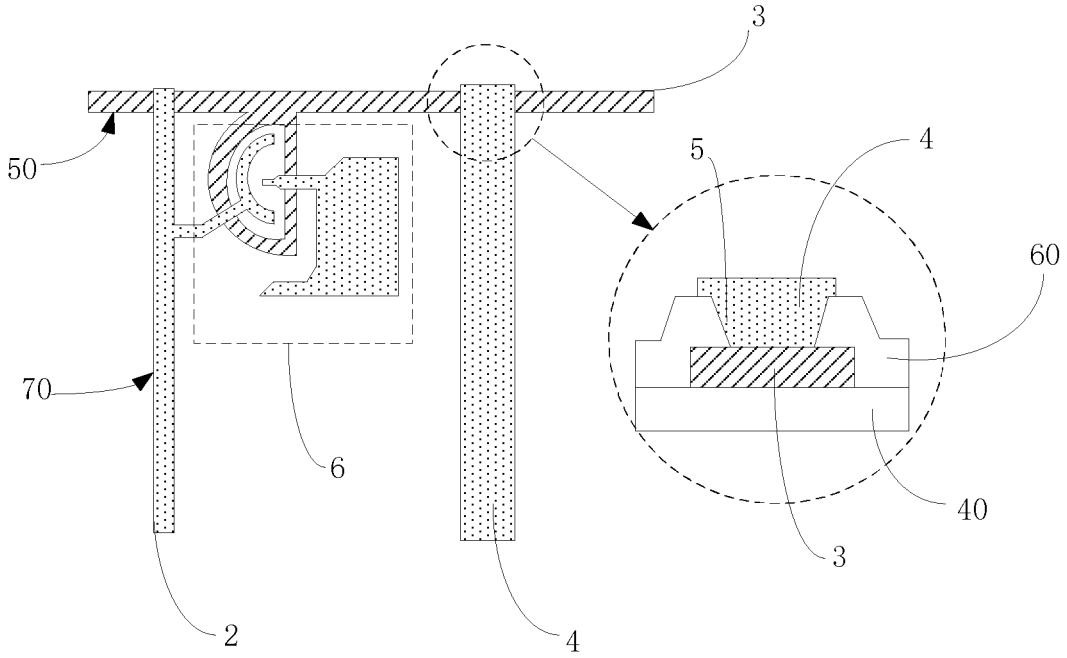
FIG. 2 is a schematic view illustrating a positional relationship among scan lines, data lines, and gate fan-out lines in the display panel according to one embodiment of the present application.

Further, the data lines 2 and the gate fan-out lines 4 are arranged in the same layer, and the scan lines 3 and the gate fan-out lines 4 are arranged in different layers. As shown in FIG. 2, the display panel comprises a substrate 40, a first metal layer 50 on the substrate 40, a gate insulating layer 60 on the substrate 40 and the first metal layer 50, and a second metal layer 70 on the gate insulating layer 60. The first metal layer 50 comprises the scan line 3, and the second metal layer 70 comprises the data lines 2 and the gate fan-out lines 4. Via holes 5 are defined in the gate insulating layer 60 and arranged in positions where the gate fan-out lines 4 and the corresponding scan lines 3 are connected, so that each gate fan-out line 4 is connected to its corresponding scan line 3 through the via hole 5.

In addition, each sub-pixel 1 includes one thin film transistor (TFT) 6. The first metal layer 50 includes a gate of the TFT 6, that is, the gate is arranged in the same layer as the scan line 3. The gate of the TFT 6 of each sub-pixel 1 is electrically connected to the scan line 3 corresponding to the row where the sub-pixel 1 is located, so that the scan line 3 inputs the scan signal to the sub-pixel 1 through the gate of the TFT 6. The second metal layer 70 comprises a source and a drain of the TFT 6, that is, the source and the drain are arranged in the same layer as the data line 2 and the gate fan-out line 4, and the source of the TFT 6 of each sub-pixel 1 is electrically connected to the data line 2 corresponding to the column where the sub-pixel 1 is located, so that the data line 2 inputs the data signal to the sub-pixel 1 through the source of the TFT 6.

The first metal layer 50 and the second metal layer 70 can be made of a conductive material such as such as copper, aluminum, silver, and other metals, or can be made of metal alloys thereof. The sub-pixels 1 comprise red sub-pixels R, green sub-pixels G, blue sub-pixels B, and etc.; however, the present application is not limited in this regard. There is a gap between two adjacent rows of the sub-pixels 1, and the scan line 3 corresponding to each row of the sub-pixels 1 is located in the gap on either side of the row of the sub-pixels to ensure that each row of the sub-pixels 1 can be electrically connected to the corresponding scan line 3.

As shown in FIG. 1, the non-display region 20 comprises a gate driver circuit 7 and a source driver circuit 8, that is, the gate driver circuit 7 and the source driver circuit 8 are located on the same side of the display region 10. The gate driver circuit 7 is electrically connected to the gate fan-out lines 4, so that the gate driver circuit 7 is electrically connected to the scan lines 3 through the gate fan-out lines 4, and when each row of the sub-pixels 1 is scanned, the gate driver circuit 7 outputs the scan signals to each row of the sub-pixels 1 through the corresponding gate fan-out line 4 and the corresponding scan line 3. The source driver circuit 8 is electrically connected to the data lines 2, so that during a period that the signals are fed to each row of the sub-pixels 1, the source driver circuit 8 sequentially sends the data signals to each sub-pixel in each row of the sub-pixels 1 through the data lines 2.

Specifically, as shown in FIG. 1, the gate driver circuit 7 comprises multi-stage gate driver units 71, and the multi-stage gate driver units 71 are electrically connected to the gate fan-out lines 4 in a one-to-one correspondence. The multi-stage gate driver units 71 are arranged side by side and spaced apart, that is, the multi-stage gate driver units 71 are arranged in sequence along the row direction B, and there is a gap between the gate driver units 71 of any two adjacent stages. The first-stage gate driver unit 71 is arranged corresponding to two adjacent columns of the sub-pixels 1, that is, a length of the first-stage gate driver unit 71 in the row direction B is the same as a length of the two adjacent columns of the sub-pixels 1 in the row direction B, and the gap between the gate driver units 71 of two adjacent stages is arranged corresponding to the gap between two columns of the sub-pixels in the sub-pixel group 30.

The source driver circuit 8 is located at one side of the gate driver circuit 7 away from the display region 10, that is, the gate driver circuit 7 is located between the source driver circuit 8 and the display region 10. The two data lines 2 in the sub-pixel group 30 extend to the non-display region 20, and extend to the source driver circuit 8 through the gap between the corresponding gate driver units 71 of two stages, and are electrically connected to the source driver circuit 8.

Figure 3:
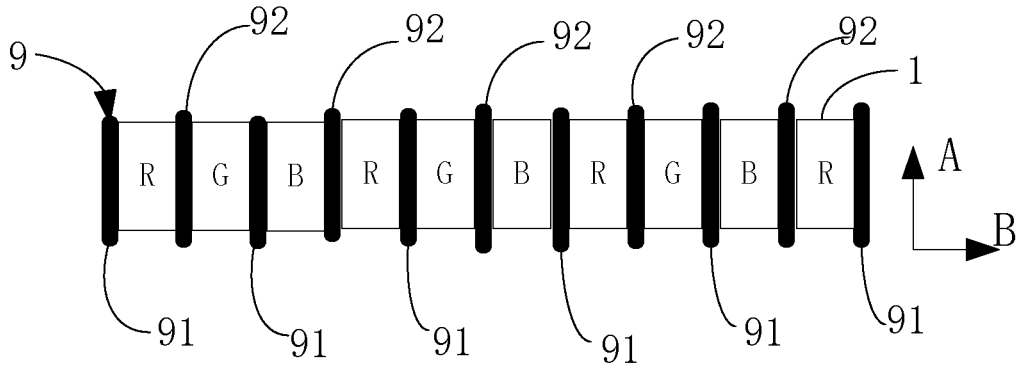
FIG. 3 is a schematic view illustrating a positional relationship between a row of sub-pixels and a light shielding layer in the display panel according to one embodiment of the present application.

Furthermore, as shown in FIG. 3, the display panel further comprises a light shielding layer 9, and the light shielding layer 9 is arranged at one side of the second metal layer 70 away from the substrate 40. The light shielding layer 9 is arranged corresponding to the data lines 2, the scan lines 3, and the gate fan-out lines 4, In other words, an orthographic projection of the light shielding layer 9 projected on the substrate 40 covers an orthographic projection of the data lines 2, the scan lines 3, and the gate fan-out lines 4 projected on the substrate 40, so that the light shielding layer 9 can cover the data lines 2, the scan lines 3, and the gate fan-out lines 4. The light shielding layer 9 can be a black matrix.

The light shielding layer 9 comprises a plurality of first light-shielding patterns 91 arranged in a one-to-one correspondence with the gate fan-out lines 4, and a plurality of second light-shielding patterns 92 arranged in a one-to-one correspondence with the two data lines 2 in each of the sub-pixel groups 30, and a plurality of third light-shielding patterns (not illustrated) arranged in a one-to-one correspondence with the scan lines 3. An orthographic projection of each first-shielding pattern 91 projected on the substrate 40 covers an orthographic projection of the corresponding gate fan-out line 4 projected on the substrate 40. An orthographic projection of each second-shielding pattern 92 projected on the substrate 40 covers an orthographic projection of the two data lines 2 in the corresponding sub-pixel group 30 projected on the substrate 40, and an orthographic projection of each third-shielding pattern projected on the substrate 40 covers an orthographic projection of the corresponding scan line 3 projected on the substrate 40.

A length of each first light-shielding pattern 91 in the row direction B is the same as a length of the second light-shielding pattern 92 in the row direction B, and a length of the first light-shielding pattern 91 in the row direction B is the same as a width of the gate fan-out line 4. A length of the second light-shielding pattern 92 in the row direction B is the same as a sum of the widths of the two data lines 2 in the sub-pixel group 30 and the width of the gap between the two data lines 2, thereby ensuring an occluded area between adjacent sub-pixels 1 is the same, thus avoiding different thicknesses in display images, and optimizing the display effects.

In summary, in the present application, the data lines and the gate fan-out lines are arranged extending along the column direction to the non-display region, every two columns of the sub-pixels constitute a group of the sub-pixels, two data lines are arranged between the two columns of the sub-pixels in each group of the sub-pixels, any two adjacent gate fan-out lines are spaced by at least one group of the sub-pixels, and the width of the gate fan-out line is not less than a sum of the widths of the two data lines in one group of the sub-pixels. Accordingly, the present application realizes a narrow-frame display panel, and at the same time, shortens signal delays in the gate fan-out lines, improves a sub-pixel charging rate, and prevents wrong charging.

In summary, although the present application has been disclosed as above in preferable embodiments, the above-mentioned preferable embodiments are not intended to limit the present application. Those of ordinary skill in the art can make various modifications and changes based on the spirit of the present application. Such modifications and changes should be deemed to fall within the protection scope of the present application. Therefore, the protection scope of the present application is defined by the appended claims.

What is claimed is:

1. A display panel, comprising a display region and a non-display region arranged at one side of the display region, wherein the display region comprises:

a plurality of sub-pixels arranged in rows and columns;

a plurality of data lines arranged in a one-to-one correspondence with the columns of the sub-pixels;

a plurality of scan lines arranged in a one-to-one correspondence with the rows of the sub-pixels; and a plurality of gate fan-out lines connected to the scan lines in a one-to-one correspondence;

wherein the data lines and the gate fan-out lines extend in a column direction to the non-display region, each two columns of the sub-pixels constitute a sub-pixel group, two data lines are arranged between the two columns of the sub-pixels in the sub-pixel group, and each two adjacent gate fan-out lines are spaced by at least one of the sub-pixel groups; and wherein a gap is defined between the two data lines in the sub-pixel group, and a width of the gate fan-out line is equal to a sum of widths of the two data lines in the sub-pixel group and a width of the gap.

2. The display panel according to claim 1, wherein the gate fan-out lines and the data lines are arranged in a same layer, and the gate fan-out lines are arranged in a different layer from the scan lines.

3. The display panel according to claim 1, wherein a gate insulating layer is arranged between the gate fan-out lines and the scan lines, via holes are defined in the gate insulating layer, and the gate fan-out lines are electrically connected to the corresponding scan lines through the via holes.

4. The display panel according to claim 1, wherein the display panel further comprises a light shielding layer; and the light shielding layer is arranged corresponding to the data lines, the scan lines, and the gate fan-out lines.

5. The display panel according to claim 4, wherein the light shielding layer comprises a plurality of first light shielding patterns and a plurality of second light shielding patterns; and orthographic projections of the first light shielding patterns projected on a layer where the gate fan-out lines are located completely cover the gate fan-out lines, and orthographic projections of the second light-shielding patterns projected on a layer where the data lines are located completely cover the two data lines in the sub-pixel group.

6. The display panel according to claim 5, wherein a length of the first light shielding pattern in a row direction is equal to a length of the second light shielding pattern in the row direction.

7. The display panel according to claim 1, wherein the non-display region comprises a gate driving circuit and a source driving circuit; and the gate driving circuit is electrically connected to the gate fan-out lines, and the source driving circuit is electrically connected to the data lines.

8. The display panel according to claim 7, wherein the gate driving circuit comprises multi-stage gate driving units; and the multi-stage gate driving units are electrically connected to the gate fan-out lines in a one-to-one correspondence.

9. The display panel according to claim 8, wherein the source driving circuit is arranged at one side of the gate driving circuit away from the display region, and the multi-stage gate driving units are arranged in parallel and spaced apart from each other; and the data lines extend to the source driving circuit through gaps between the multi-stage gate driving units, and are electrically connected to the source driving circuit.

10. A display panel, comprising a display region and a non-display region arranged at one side of the display region, wherein the display region comprises:

a plurality of sub-pixels arranged in rows and columns;

a plurality of data lines arranged in a one-to-one correspondence with the columns of the sub-pixels;

a plurality of scan lines arranged in a one-to-one correspondence with the rows of the sub-pixels; and a plurality of gate fan-out lines connected to the scan lines in a one-to-one correspondence;

wherein the data lines and the gate fan-out lines extend in a column direction to the non-display region, each two columns of the sub-pixels constitute a sub-pixel group, two data lines are arranged between the two columns of the sub-pixels in the sub-pixel group, and each two adjacent gate fan-out lines are spaced by at least one of the sub-pixel groups;

wherein a width of the gate fan-out line is greater than or equal to a sum of widths of the two data lines in the sub-pixel group.

11. The display panel according to claim 10, wherein the gate fan-out lines and the data lines are arranged in a same layer, and the gate fan-out lines and the scan lines are arranged in different layers.

12. The display panel according to claim 10, wherein a gate insulating layer is arranged between the gate fan-out lines and the scan lines, via holes are defined in the gate insulating layer, and the gate fan-out lines are electrically connected to the corresponding scan lines through the via holes.

13. The display panel according to claim 10, wherein the display panel further comprises a light shielding layer; and the light shielding layer is arranged corresponding to the data lines, the scan lines, and the gate fan-out lines.

14. The display panel according to claim 13, wherein the light shielding layer comprises a plurality of first light shielding patterns and a plurality of second light shielding patterns; and orthographic projections of the first light shielding patterns projected on a layer where the gate fan-out lines are located completely cover the gate fan-out lines, and orthographic projections of the second light shielding patterns projected on a layer where the data lines are located completely cover the two data lines in the sub-pixel group.

15. The display panel according to claim 14, wherein a length of the first light shielding pattern in a row direction is the same as a length of the second light shielding pattern in the row direction.

16. The display panel according to claim 10, wherein the non-display region comprises a gate driving circuit and a source driving circuit; and the gate driving circuit is electrically connected to the gate fan-out lines, and the source driving circuit is electrically connected to the data lines.

17. The display panel according to claim 16, wherein the gate driving circuit comprises multi-stage gate driving units; and the multi-stage gate driving units are electrically connected to the gate fan-out lines in a one-to-one correspondence.

18. The display panel according to claim 17, wherein the source driving circuit is arranged at one side of the gate driving circuit away from the display region, and the multi-stage gate driving units are arranged in parallel and spaced apart from each other; and the data lines extend to the source driving circuit through gaps between the multi-stage gate driving units, and are electrically connected to the source driving circuit.

* * * * *